US012371950B2

(12) United States Patent
Ramsauer et al.

(10) Patent No.: US 12,371,950 B2
(45) Date of Patent: Jul. 29, 2025

(54) IMPACT DEVICE FOR A DRILL STRING

(71) Applicant: THINK AND VISION GMBH, Leoben (AT)

(72) Inventors: Medardus Ramsauer, Kuchl (AT); Anton Kotov, Samara (RU)

(73) Assignee: THINK AND VISION GMBH, Leoben (AT)

( * ) Notice: Subject to any disclaimer, the term of this patent is extended or adjusted under 35 U.S.C. 154(b) by 0 days.

(21) Appl. No.: 18/554,165

(22) PCT Filed: Apr. 21, 2022

(86) PCT No.: PCT/EP2022/060551
§ 371 (c)(1),
(2) Date: Oct. 5, 2023

(87) PCT Pub. No.: WO2022/223691
PCT Pub. Date: Oct. 27, 2022

(65) Prior Publication Data

US 2024/0117683 A1 Apr. 11, 2024

(30) Foreign Application Priority Data

Apr. 23, 2021 (AT) ..... A 50306/2021

(51) Int. Cl.
*E21B 17/02* (2006.01)
*E21B 17/00* (2006.01)
*E21B 31/107* (2006.01)

(52) U.S. Cl.
CPC ..... *E21B 17/023* (2013.01); *E21B 17/003* (2013.01); *E21B 31/107* (2013.01)

(58) Field of Classification Search
CPC ..... E21B 17/023; E21B 17/003
See application file for complete search history.

(56) References Cited

U.S. PATENT DOCUMENTS 1,672,200 A * 6/1928 Buck ..... E21B 36/04 134/5
6,481,495 B1 * 11/2002 Evans ..... E21B 31/107 175/321

(Continued)

FOREIGN PATENT DOCUMENTS

WO 2010141969 A2 12/2010
WO 2013126936 A2 9/2013
WO 2014012349 A1 1/2014

OTHER PUBLICATIONS

International Search Report for PCT/EP2022/060551 mailed Jul. 21, 2022, 6 pages.

(Continued)

*Primary Examiner* — David Carroll
(74) *Attorney, Agent, or Firm* — NIXON & VANDERHYE

(57) ABSTRACT

An impact device for a drill string has a pipe with a variable length and a longitudinal extension, which has a first pipe element and a second pipe element that can be moved in the direction of the longitudinal extension relative to the first pipe element, which second pipe element is accommodated in the first pipe element. An electrical line runs from the first pipe element to the second pipe element, which line is connected to the first pipe element and the second pipe element and is wound coil-like in a central section around the second pipe element. A coil-like groove is arranged on the first pipe element and/or on the second pipe element, in which groove lies an area of the central section of the line.

17 Claims, 6 Drawing Sheets

(56) References Cited

U.S. PATENT DOCUMENTS

| | | | | |
|---|---|---|---|---|
| 6,991,035 | B2 | 1/2006 | Hall et al. | |
| 7,852,232 | B2 * | 12/2010 | Hall | E21B 17/003 340/854.4 |
| 2003/0070842 | A1 | 4/2003 | Bailey et al. | |
| 2004/0150533 | A1 * | 8/2004 | Hall | E21B 17/07 340/854.4 |
| 2005/0045339 | A1 * | 3/2005 | Hall | E21B 17/003 166/380 |
| 2018/0073306 | A1 | 3/2018 | Verhoef et al. | |

OTHER PUBLICATIONS

Written Opinion of the ISA for PCT/EP2022/060551 mailed Jul. 21, 2022, 5 pages.

* cited by examiner

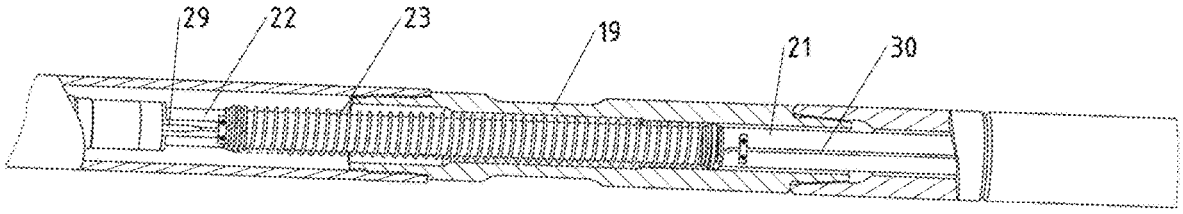
Fig. 5
Fig. 6
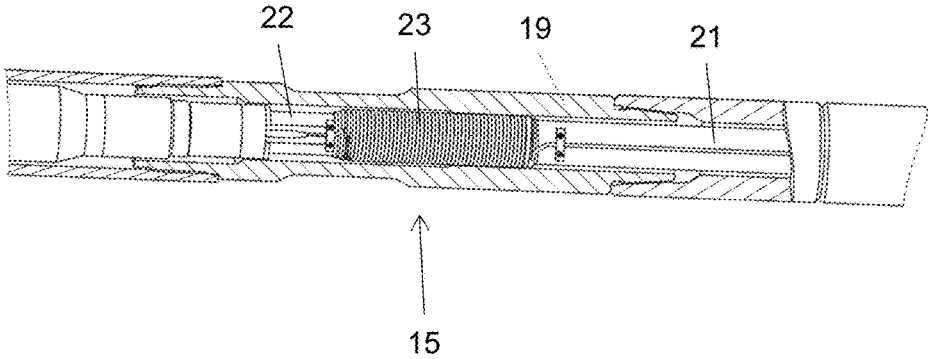

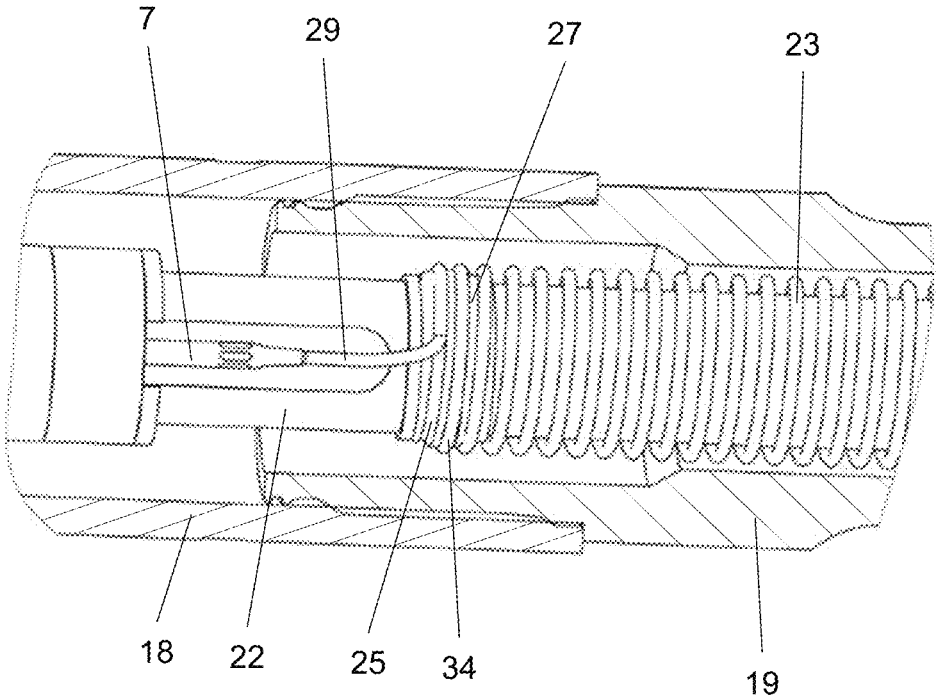
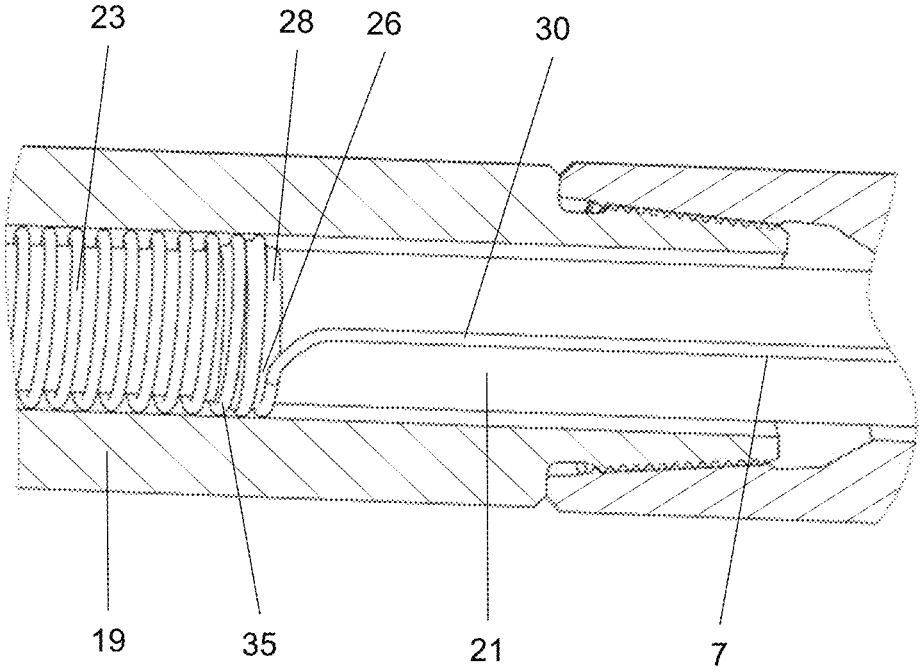
Fig. 8

IMPACT DEVICE FOR A DRILL STRING

CROSS-REFERENCE TO RELATED APPLICATIONS

This application is the US national stage of PCT/EP2022/060551, filed Apr. 21, 2022 and designating the United States, which claims the priority of AT A 50306/2021, filed Apr. 23, 2021. The entire contents of each foregoing application are incorporated herein by reference.

BACKGROUND OF THE INVENTION

Field of the Invention

The invention relates to an impact device, in particular for a drill string, which has a pipe with a variable length and a longitudinal extension, which has a first pipe element and a second pipe element that can be moved in the direction of the longitudinal extension relative to the first pipe element, which second pipe element is accommodated at least in sections in the first pipe element, wherein at least one electrical line runs from the first pipe element to the second pipe element, which line is connected to the first pipe element and the second pipe element and is wound coil-like in a central section around at least one of the two pipe elements, preferably the second pipe element.

Description of the Related Art

Impact devices (in English, "jars" or "drilling jars") are components of drilling equipment known in the field of drilling technology, in particular in crude oil, natural gas, and geothermal energy drilling. An impact device is a tool that is used when the drill string is stuck or can no longer be easily dislodged or run up or down in the borehole. The impact device is normally located approximately in the area of the "neutral point" of the drill string, i.e., any area in which the drill string experiences neither tensile forces nor compressive forces during drilling. This area is usually located in the upper part of the "tool fixture" (in English: "bottom hole assembly" or "BHA"), i.e., approximately 100 m to 200 m above the drill head. However, the impact device can, of course, also be arranged elsewhere, and this makes it possible for an operator on the surface to pound on the drill string or the drill head and to dislodge the drill string or the drill head again. In a frequently-used design of such an impact device, the latter has two parts that can be moved relative to one another in the longitudinal direction of the drill string, wherein the movable part usually has a hammer, which strikes an anvil mounted immovably on the drill string, with which the part of the drill string jammed in the borehole can be dislodged again by the impact or multiple impacts.

An essential element in modern drilling processes, in particular in crude oil, natural gas, and geothermal energy drilling, is the data acquisition and the control of the various modules of the drill string during the drilling process, when going in and out of the borehole or in other treatment actions with the drill string in the borehole, as well as optionally the electric power supply of the modules. To this end, one or more lines extend along the drill string from the surface to the drill head. In the area of an impact device, however, problems arise with a controlled pipeline configuration, since the axial longitudinal change of the drill string in the area of the impact device has to be compensated for. In this case, it has been known for a long time (e.g., U.S. Pat. No. 6,991,035 B2) to wind the line coil-like around one of the two pipe elements that can be moved axially relative to one another, wherein the longitudinal change of the drill string can easily be compensated for by the coil-like winding. The transition region between the section of the line wound coil-like and the connecting sections adjacent thereto on both sides is problematic, however, since the line there has a sharp bend or a curvature with a relatively small radius, which is subject to high stress in the case of repeated actuation of the impact device and because of the oscillations that occur during the drilling process.

SUMMARY OF THE INVENTION

The object of the invention is therefore to improve the fastening of the line in the impact device.

This object is achieved with an impact device with the features of claim 1.

According to the invention, at least one coil-like groove is arranged on a pipe section, preferably on two pipe sections, in which groove in each case lies an area of the central, coil-like section of the line. Since the line in the coil-like groove is held essentially in the same position, as in the central area, in which the line wound coil-like compensates for the longitudinal change, the line can be connected largely stress-free to one or both pipe elements, by which the following transition region is held stress-free in the connecting section(s).

Although the line does not have to be accommodated in the groove in the area of one end of the central section, but rather the central area wound coil-like could extend out over the respective groove, it is nevertheless preferred in the case of the invention when the line is accommodated in the groove in the area of one end of the central section. The transition region can then be located immediately adjacent to the connecting section(s).

The line can be kept in the groove by a fastening means, preferably a clamp or sleeve.

As an alternative, it is also possible in the case of the invention that the line is fastened to the connecting section on the pipe element, preferably by means of a clamp, wherein this fastening is ideally (but not necessarily) carried out immediately behind the groove or the end of the coil-like, central section.

According to the invention, the coil-like groove could be attached directly to one or the other pipe element. It is preferred, however, when the coil-like groove is arranged on a sleeve that is fastened to a pipe element, since this is simpler in manufacturing technology.

It is known from the state of the art that the line is accommodated at least in the central section, optionally also in the adjacent connecting sections, in a preferably metal, elastic cover. This is also preferred in the case of the impact device according to the invention. In this case, according to the invention, the cover is in the groove, wherein all embodiments and advantages described above in connection with the line also apply to the cover with the line accommodated therein.

Additional preferred embodiments of the invention are the subject matter of the other subclaims.

BRIEF DESCRIPTION OF THE DRAWINGS

Additional features and advantages of the invention follow from the subsequent description of preferred embodiments of the invention that are not limited to the scope of protection, with reference to the accompanying drawings. Here:

FIG. 5 shows a detail of FIG. 2, enlarged, FIG. 6 shows a detail of FIG. 3, enlarged, FIG. 7 shows another detail of the impact device according to the invention, enlarged, FIG. 8 shows still another detail of the impact device according to the invention, enlarged.

DETAILED DESCRIPTION

Figure 1:
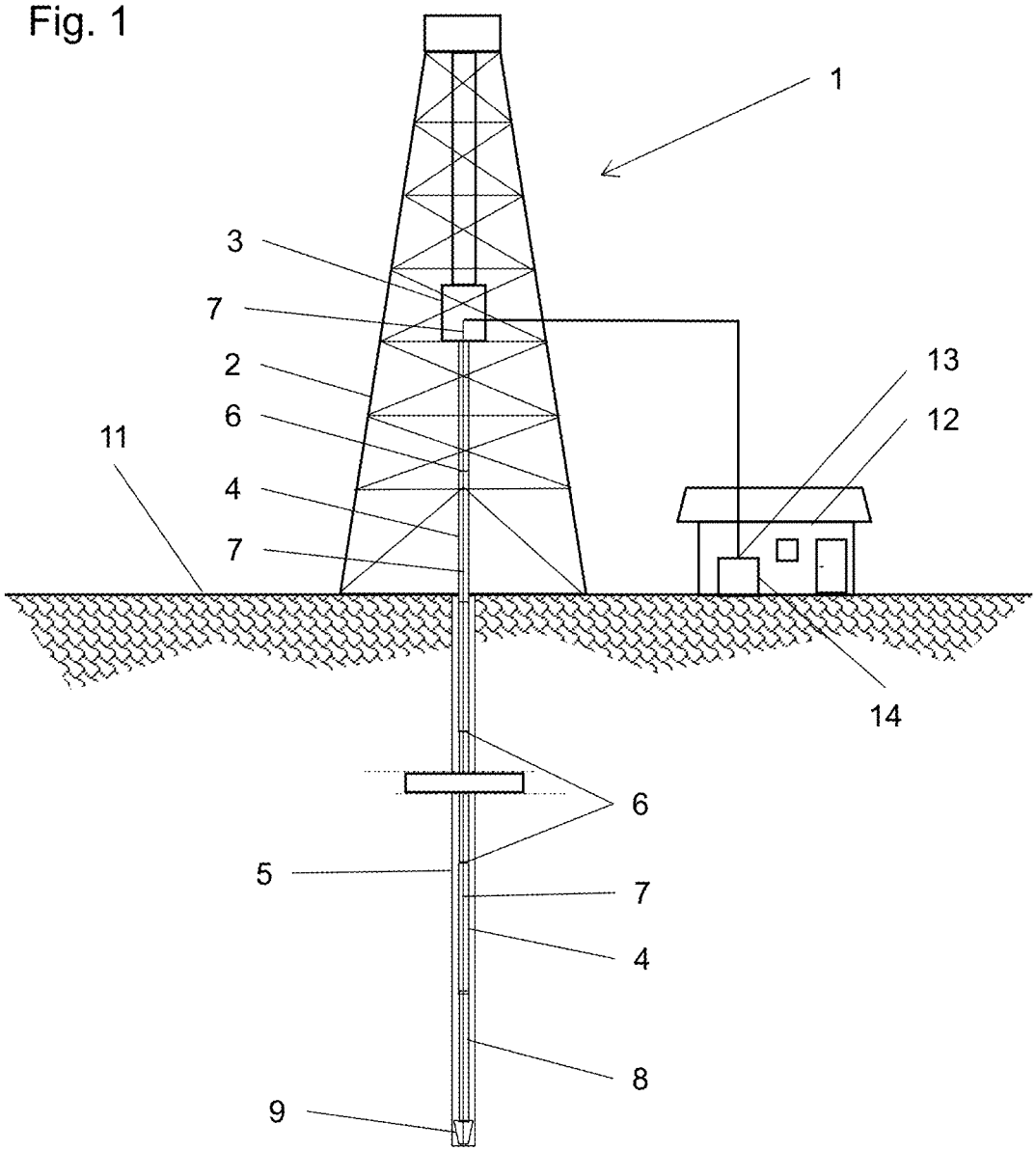
FIG. 1 shows a diagrammatic depiction of a drill rig.

In the drawings, embodiments of an impact device according to the invention are depicted, which embodiments are intended only as examples, however, and, aside from the features according to the invention, as defined in the claims, can also be implemented differently within the scope of this invention as regards many components, without this requiring special mention below.

FIG. 1 diagrammatically depicts a drill rig 1 with an oil rig tower 2, with which drill pipes 4 that are connected to a drill string are driven in rotation via a drive 3, a so-called "top drive," in order to produce a borehole 5. It is understood that the design of the drill rig 1 is intended only as an example and can also be implemented in various other ways known from the state of the art.

The drill pipes 4 are connected via couplings 6 to a connecting rod, wherein one or more electrical lines 7 are arranged in the drill pipes 4, which lines, for example, can run inside the drill pipes 4 as depicted and described in WO 2013/126936 A. The couplings 6 make possible a galvanic connection of the electrical lines 7 that run in the individual drill pipes 4 and can be designed, for example, as depicted and described in WO 2010/141969 A. Another path of the electrical lines 7 inside the drill pipes and another design of the couplings 6 are, of course, also possible. A galvanic connection of the electrical lines 7 is preferred, but not necessary, in the area of the couplings 6.

In the depicted embodiment, instead of the lowest drill pipe 4, an impact device 8 according to the invention is provided.

A drill head 9 or any other tool or element of the drill string is mounted on the lower end of the impact device. In the drill head 9 and, moreover, also on or in several or optionally also all drill pipes 4, there can be electrical consumers, sensors, modules, or the like, which are not depicted and which are connected to the electrical lines 7.

On the surface, i.e., over the bottom 11 or, for example, a platform of an offshore rig on which the drill rig 1 can be arranged, there is, in a protected area, for example, a building 12, a container or the like, a connector 13 for electric power, and/or a control unit 14 for feeding and/or receiving control signals or measurement data.

Figure 2:
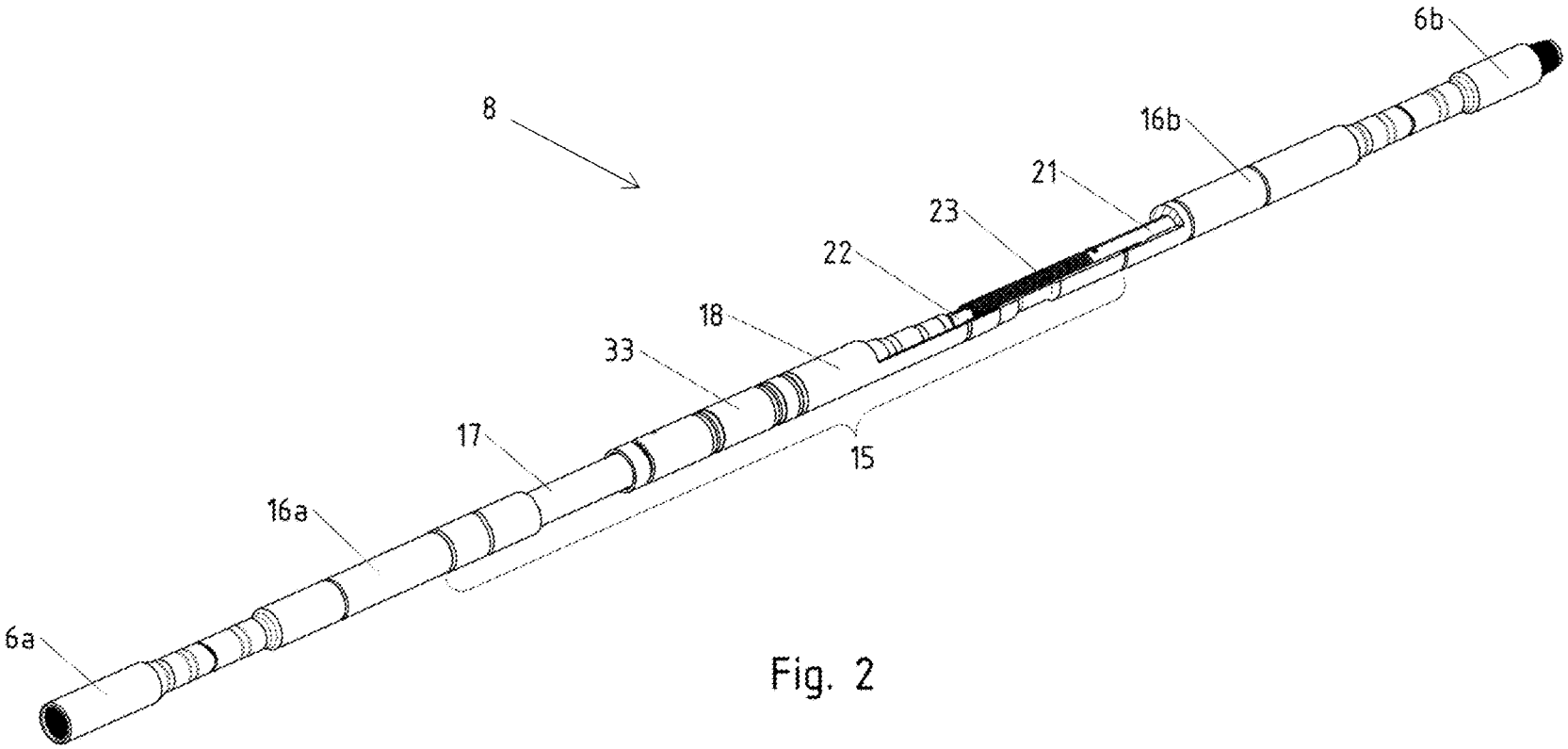
FIG. 2 shows an embodiment of an impact device, according to the invention, in the inclined crack, partial cutaway.

In partial cutaway, FIG. 2 depicts an embodiment of an impact device 8 according to the invention. It essentially consists of a central part 15 with in each case a connecting part 16*a*, 16*b* on the two ends. In the depicted embodiment, the connecting part 16*a* has a box 6*a* with a conical inside thread, and the connecting part 16*b* has a pin 6*b* with a conical outside thread. Also, each drill pipe 4 has a corresponding box 6*a* and a pin 6*b*, which together form a coupling 6, on the drill pipe 4, one or more impact devices 8, as well as other technical devices, which can be screwed together, if necessary, inside the drill string or can be arranged on its end (e.g., the drill head 9).

The central part 15, which forms the functionally active part of the impact device 8, has—in the installation position—an upper part 17 and a lower part 18, which can be moved relative to one another. In particular, in the depicted embodiment, the smaller-diameter upper part 17 can be moved inside the larger-diameter lower part 18.

The lower part 18 has a sheath 19, in which a first pipe element 21 and a second pipe element 22 are accommodated that can be moved relative to one another. In the embodiment depicted in the drawings, the first pipe element 21 has a larger diameter than the second pipe element 22, and the second pipe element 22 can be moved inside the first pipe element 21 in the longitudinal extension of the pipe elements 21, 22 or the impact device 8.

Figure 3:
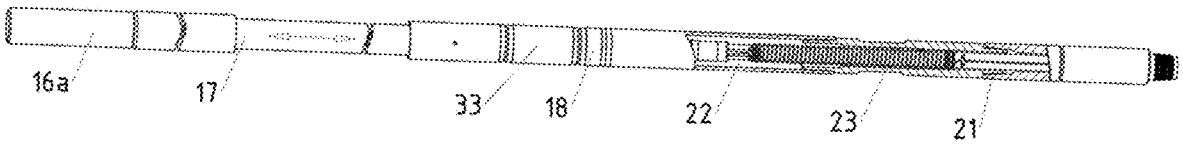
FIG. 3 shows a central part of the impact device of FIG. 2 in the exploded state.
Figure 4:
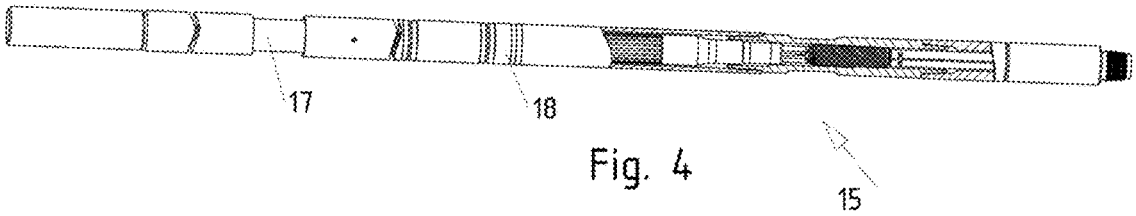
FIG. 4 shows the central part of the impact device of FIG. 2 in the pushed-together state.

The upper part 17 is connected mechanically securely to the second pipe element 22. When the upper part 17 is extracted from the lower part 18, the second pipe element 22 is thus also extracted from the first pipe element 21. FIGS. 3 and 5 depict the position in which under normal operating conditions, the second pipe element 22 is extracted as far as possible from the first pipe element 21, and FIGS. 4 and 6 depict the position in which under normal operating conditions, the second pipe element 22 is pushed as far as possible into the first pipe element 21.

The electrical line 7 also runs through the impact device 8 from the box 6*a* to the pin 6*b*. Since the connecting part 16*a* is connected rigidly to the upper part 17, and the upper part 17 is connected rigidly to the second pipe element 22, the conductor 7 can run essentially extended in this area and in the direction of the longitudinal extension of the impact device 8. In turn, the lower part 16*b* is connected rigidly to the first pipe element 21, so that the conductor 7 can also run essentially extended in this area and in the direction of the longitudinal extension of the impact device 8.

Between the first pipe element 21 and the second pipe element 22, however, equalizing the length of the line 7 is necessary, since these two pipe elements 21, 22 can be moved against one another in the longitudinal direction. For this purpose, the line 7 is wound coil-like in a central section 23 around the second pipe element 22, wherein length can easily be equalized by the windings, as FIGS. 3 to 6 show in particular.

Figure 9:
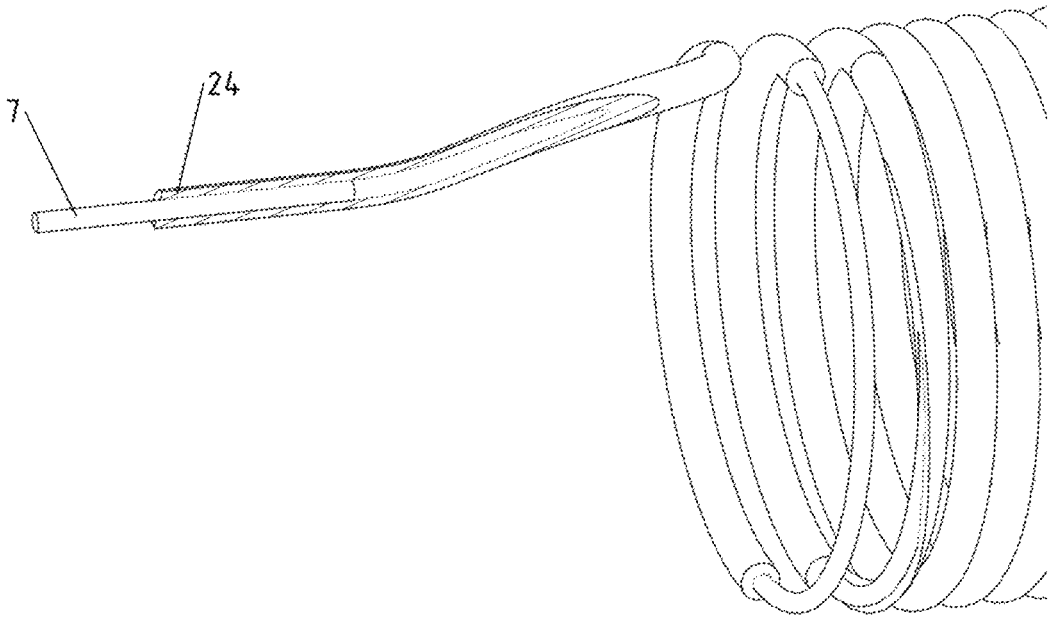
FIG. 9 shows the design of an electrical conductor that is protected in a partially cutaway cover.

The line 7 (there can also be multiple lines) is accommodated in the impact device 8 from the box 6*a* to the pin 6*b* in a metal cover 24 or a metal tube, by which the line 7 is protected from harmful environmental influences. FIG. 9 depicts an end section 34 of the central section 23 of the line 7 with the section adjacent thereto. It is evident that the line 7 is accommodated in the cover 24, which is depicted in partial cutaway.

In order to connect the line 7 or the cover 24 thereof to the first pipe element 21 and the second pipe element 22, a coil-like groove 25, 26 is attached to each of the pipe elements 21, 22, in which groove in each case lies an end section 34, 35 of the central section 23 of the line 7 or the cover 24. This can best be seen in FIGS. 7 and 8.

A first connecting section 29 and a second connecting section 30 of the line 7 or cover 24 connect to the end sections 34, 35 of the central, coil-like section 23 of the line 7 or the cover 24.

The grooves 25 and 26 could theoretically be formed directly on the pipe elements 21, 22, for example by machining. In the preferred embodiments depicted in the drawings (see in particular FIGS. 7 and 8), the coil-like grooves are, however, arranged on sleeves 27, 28, which are fastened to the pipe elements 21, 22. Also, a combination of embodiments would be possible, of course, by only one sleeve 27 or 28 being provided on one of the two pipe elements 21 or 22.

The line 7 or the cover 24 thereof can be held with sufficient depth of the grooves 25, 26, a sufficiently high strength of the cover 24, and a sufficiently large winding number without special, additional fastening, without the cover 24 being extracted from the grooves 25, 26 when the first pipe element 21 and the second pipe element 22 are pulled apart in the position depicted in FIGS. 3 and 5.

For safety purposes, however, it is also possible that the cover 24 is in addition fastened in the grooves 25, 26. This can be done by any fastening technology, in particular a non-positive, positive, and/or integral connection, for example, gluing, or a clamp or sleeve, not depicted in the drawings, which is driven via the connecting area. Also, a stabilization of the cover 24 by a sheath 19 arranged in the critical area above the grooves 25, 26 (at a short distance from the cover 24), which prevents the cover 24 from slipping out of the grooves 25, 26, is possible. This embodiment is depicted in, for example, FIG. 8.

In an especially preferred embodiment of the impact device according to the invention, the connecting sections 29, 30 behind the bent transition region (between the ends 34, 35 of the coil-like, central section 23 and the extended connecting sections 29, 30) are additionally secured by means of clamps 31, 32, with which, on the one hand, a reliable traction relief of the connecting sections 29, 30, and, on the other hand, a safety device are provided, so that the cover 24 is not extracted from the grooves 25, 26.

FIGS. 7 and 8 depict an embodiment without clamps 31, 32.

Any combination of the above-described measures for keeping the conductor 7 or the cover 24 from being extracted from the grooves 25, 26 is, of course, also possible.

The design of the impact device 33, i.e., the unit inside the impact device 8, which generates the pounding or impact, if necessary, is not described structurally in any further detail, since it is well known from the state of the art. The function of the impact device 33 consists in storing the deformation energy (in the case of double-acting impact devices both by tension and compression) of the drill string, when a snug drill string is extracted from the borehole 5 or is pressed into the borehole 5, since, for example, the drill head 9 or a part of the drill rod is clamped.

In this invention, in this case, in the example of an impact device acting only in tension, starting from the position depicted in FIGS. 4 and 6, the upper part 17 is extracted from the lower part 18 and consequently also the second pipe element 22 is extracted from the first pipe element 21 in the position depicted in FIGS. 3 and 5. The second pipe element 22 or an associated part projects into the impact device 33 and builds up a force through the relative movement (a pressure in the case of hydraulic impact devices), which is abruptly released after crossing a certain path or a certain force (or a certain pressure), which is also referred to as "firing," so that a hammer fastened to, for example, the second pipe element 22 or the associated part hits an anvil fastened to, for example, the impact device 33 with great force and by this impact dislodges the snug component of the drill string. If a first impact is not sufficient and the drill string is still blocked, the drill string is lowered again, so that the impact device 8 again reaches the position depicted in FIGS. 4 and 6, at which point a renewed impact for dislodging the snug component can be generated by re-extracting the upper part 17 from the lower part 18.

The invention can be applied in the same way with an impact device operating under pressure. In this case, the starting position would be the extended position depicted in FIGS. 3 and 5, and the impact device is pressed together into the position depicted in FIGS. 4 and 6 until it fires. In the case of a double-acting impact device, the neutral starting position would be a central position between the position depicted in FIGS. 3 and 5, on the one hand, and the position depicted in FIGS. 4 and 6, on the other hand. For firing, the impact device can then be both pulled apart in the position depicted in FIGS. 3 and 5 and pressed together in the position depicted in FIGS. 4 and 6.

REFERENCE SYMBOL LIST

1 Drill rig
2 Oil rig tower
3 Drive
4 Drill pipe
5 Borehole
6 Coupling
**6*a*** Box
**6*b*** Pin
7 Electrical line
8 Impact device
9 Drill head
10 -
11 Bottom
12 Building
13 Connector
14 Control unit
15 Central part
**16*a*** Connecting part
**16*b*** Connecting part
17 Upper part
18 Lower part
19 Sheath
21 First pipe element
22 Second pipe element
23 Central section
24 Cover
25 Coil-like groove
26 Coil-like groove
27 Sleeve
28 Sleeve
29 First connecting section
30 Second connecting section
31 Clamp
32 Clamp
33 Impact device
34 End of the central section
35 End of the central section

The invention claimed is:

1. An impact device comprising:

a pipe with a variable length and a longitudinal extension, the pipe comprising:

a first pipe element; and a second pipe element that can be moved a direction of the longitudinal extension relative to the first pipe element, which second pipe element is accommodated at least in sections in the first pipe element, at least one electrical line running from the first pipe element to the second pipe element, the electrical line being connected to the first pipe element and the second pipe element and wound coil-like in a central section around at least one of the first and second pipe elements, wherein a coil-like groove is arranged on the first pipe element and/or on the second pipe element, in which groove lies an end area of the central section of the at least one electrical line, and wherein the at least one electrical line has a connecting section adjacent to the end area of the central section of the electrical line.

2. The impact device according to claim 1, further comprising a clamp configured to hold the at least one electrical line in the groove.

3. The impact device according to claim 1, wherein the connecting section of the electrical line is extended adjacent to the central section of the electrical line.

4. The impact device according to claim 1, wherein the at least one electrical line is fastened to the connecting section on the first or second pipe element.

5. An impact device comprising:

a pipe with a variable length and a longitudinal extension, the pipe comprising:

a first pipe element; and a second pipe element that can be moved in a direction of the longitudinal extension relative to the first pipe element, which second pipe element is accommodated at least in sections in the first pipe element, at least one electrical line running from the first pipe element to the second pipe element, the the electrical line being connected to the first pipe element and the second pipe element and wound coil-like in a central section around at least one of the first and second pipe elements, wherein a coil-like groove is arranged on the first pipe element and/or on the second pipe element, in which groove lies an end area of the central section of the at least one electrical line, and wherein the coil-like groove is arranged on a sleeve, which is fastened to one of the first and second pipe elements.

6. The impact device according to claim 1, wherein the at least one electrical line is accommodated at least in the central section of the electrical line in an elastic cover, and wherein the cover lies in the groove.

7. The impact device according to claim 1, wherein the at least one electrical line is accommodated in the connecting section in the cover, wherein the at least one electrical line is accommodated at least in the central section of the electrical line in an elastic cover, and wherein the cover lies in the groove.

8. The impact device according to claim 1, wherein the pipe is enclosed by a sheath on at least one part of the pipe's length.

9. The impact device according to claim 1, further comprising a clamp configured to hold the at least one electrical line in the groove.

10. The impact device according to claim 9, wherein the at least one electrical line has a connecting section adjacent to the central section of the electrical line on at least one end.

11. The impact device according to claim 10, wherein the connecting section is extended adjacent to the central section of the electrical line.

12. The impact device according to claim 11, wherein the at least one electrical line is fastened to the connecting section on the first or second pipe element.

13. The impact device according to claim 12, wherein the coil-like groove is arranged on a sleeve, which is fastened to one of the first or second pipe elements.

14. The impact device according to claim 13, wherein the line is accommodated at least in the central section of the electrical line in an elastic cover, and wherein the cover lies in the groove.

15. The impact device according to claim 1, wherein the pipe is enclosed by a sheath on at least one part of the pipe's length.

16. The impact device according to claim 1, wherein the coil-like groove is arranged on a sleeve, which is fastened to one of the first and second pipe elements.

17. The impact device according to claim 2, wherein the coil-like groove is arranged on a sleeve, which is fastened to one of the first and second pipe elements.

* * * * *